United States Patent [19]

Claunch

[11] 4,163,616

[45] Aug. 7, 1979

[54] TOP-TO-BOTTOM MIXER

[75] Inventor: C. Kenneth Claunch, Erie, Pa.

[73] Assignee: Finish Engineering Company, Inc., Erie, Pa.

[21] Appl. No.: 889,371

[22] Filed: Mar. 23, 1978

[51] Int. Cl.[2] ..... B01F 5/12

[52] U.S. Cl. ..... 366/262

[58] Field of Search ..... 366/262, 264, 265, 241, 366/170, 169, 108, 605; 261/84, 85, 93

[56] References Cited

U.S. PATENT DOCUMENTS

| | | | |
|---|---|---|---|
| 3,106,383 | 10/1963 | Philipps | 366/262 |

FOREIGN PATENT DOCUMENTS

| | | | |
|---|---|---|---|
| 523717 | 11/1953 | Belgium | 366/262 |
| 1155343 | 4/1958 | France | 366/262 |
| 523770 | 4/1955 | Italy | 366/262 |
| 552254 | 11/1956 | Italy | 366/262 |

*Primary Examiner*—Edward J. McCarthy
*Attorney, Agent, or Firm*—Charles L. Lovercheck

[57] ABSTRACT

A top-to-bottom mixer suitable for extending through a small opening in a closed top drum for mixing liquid. The mixer has a tube for extending axially downward into the drum. Since closed top drums in commerce have a maximum top opening of 2" pipe size, this mixer is additionally unique in that it will insert into this small opening.

The tube has a circumferentially located opening adjacent the lower end and a shaft extending concentrically into the tube, connected to a turbine at the bottom of the tube or other means for causing downflow. Four spaced inlet openings at the top are provided in the tube adjacent the upper end. The motor drive, connected to the shaft, rotates the shaft, creating a steady suction effect at the upper intake ports that draw liquid into the inlet openings adjacent the top of the tube and discharge it tangentially through the discharge opening at the lower end of the tube, thereby circulating the liquid in from the top to the bottom of the drum and discharging the liquid at the bottom in a jet-like, high-pressure blast the loosens, suspends and sets in motion, packed and settled mass, such as settled sludge.

14 Claims, 5 Drawing Figures

FIG. 1.
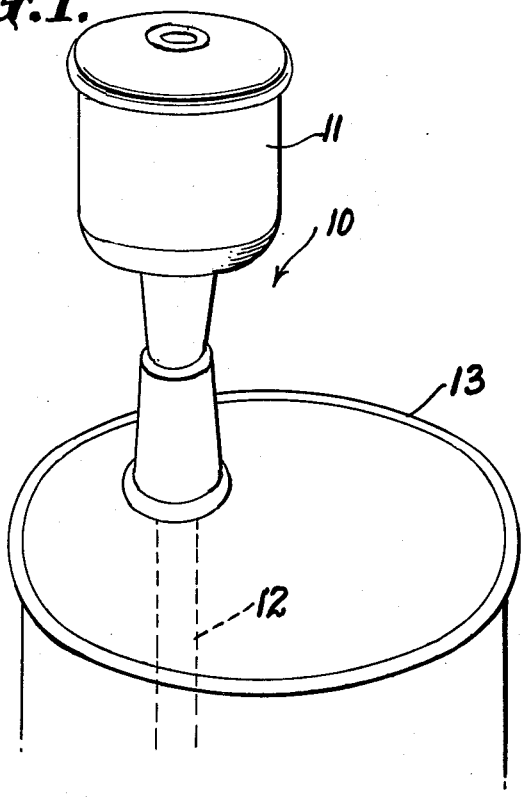
FIG. 2.
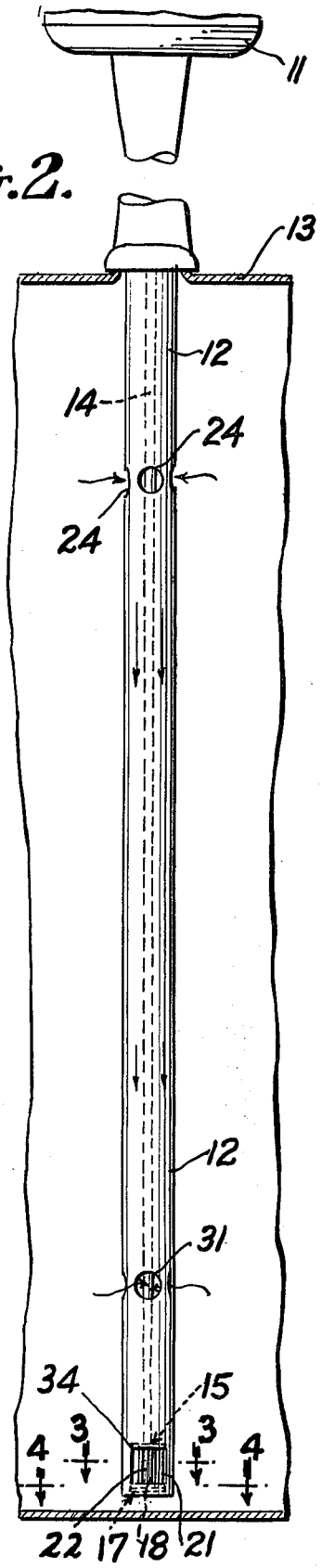
FIG. 3.
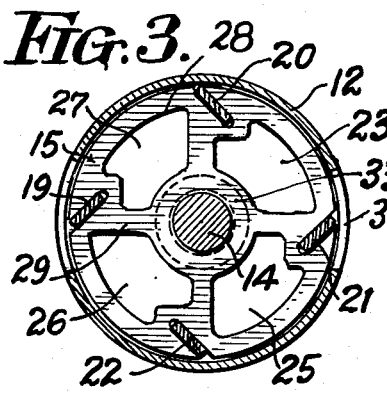
FIG. 4.
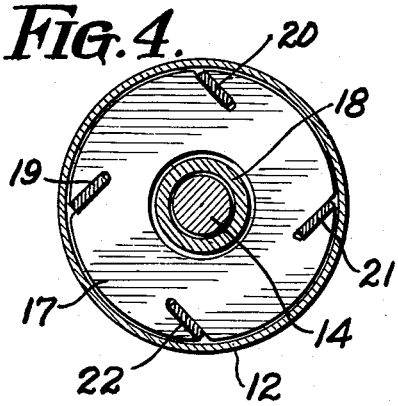
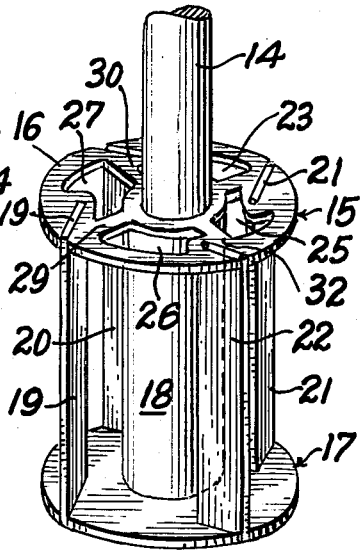
FIG. 5.

TOP-TO-BOTTOM MIXER

GENERAL STATEMENT OF THE INVENTION

The positive top-to-bottom mixer disclosed herein has a jet-type discharge at the bottom which creates a high-pressure blast at the bottom of a drum or a tank that will loosen, suspend and set into motion masses that have settled and packed on the bottom of the drum or tank. In operation, a shaft mounted to a turbine inside the tube rotates at high speed creating a steady suction effect at four upper inlet ports positioned to insure flow from a partially full drum. Material to be mixed is drawn down inside the tube and discharged with violent force through ports at the tank bottom impinging into the settled particles.

The purpose of this mixer is to make it possible to provide a vigorous agitation in a closed container and give violent agitation at the bottom of the container creating a steady suction effect at four intake ports at the top moving the material down inside the tube and discharging it with violent force through the ports at the tank bottom impinging into the settled particles at the bottom of the tank thereby agitating them at a point where the agitation is most needed. The turbine at the base of the tube being closed is not susceptible to damage. Most mixers introduce air causing foaming and/or unintended reactions and poor mixing. The mixer disclosed herein cannot introduce air into the liquid because the circulation caused by the pump takes place inside the liquid itself. Since the material travels through the tube to the impeller, no air can be introduced that would cause unwanted reaction and/or foaming.

In the example disclosed, when two heterogeneous materials are to be mixed and one of the materials has settled out as a sludge in the bottom of the containers, such as paint, agitation particularly at the bottom of the container is needed. Another instance where this pump is especially suitable for use is where one material deposits crystals when cooled as in shipment. The normal way to dissolve crystals is to use drum band heaters to redissolve crystals. The mixer disclosed herein will dissolve the crystals at room temperature because of the violent agitation that takes place.

REFERENCE TO PRIOR ART

Patents showing the general type of mixer disclosed herein are shown in U.S. Pat. No. 1,362,131; U.S. Pat. No. 1,949,696; U.S. Pat. No. 2,206,266; and U.S. Pat. No. 2,530,814. None of these patents show a top-to-bottom mixer like that disclosed and claimed herein.

OBJECTS OF THE INVENTION

It is an object of the invention to provide an improved mixer.

Another object of the invention is to provide a mixer that can be inserted through a relatively small opening in a closed top container providing a large flow in the material with a discharge at the bottom of the material.

Another object of the invention is to provide a mixer that is simple in construction, economical to manufacture, and simple and efficient to use.

Another object of the invention is to provide an improved, high-pressure mixer.

Another object of the invention is to cause mixing by a very high top-to-bottom circulation rate. In a standard 55 gallon drum, the total contents will be circulated once every two (2) minutes.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

FIG. 1 is a partial, isometric view of the mixer according to the invention.

FIG 2. is a longitudinal, cross-sectional view showing the mixer in a tank or container with the container parts broken away to better show the invention.

FIG. 3 is a longitudinal, cross-sectional view taken on line 3—3 of FIG. 2.

FIG. 4 is a longitudinal view taken on line 4—4 of FIG. 2.

FIG. 5 is an isometric view of the turbine according to the invention.

DETAILED DESCRIPTION OF THE INVENTION

Now, with more particular reference to the drawings, the top-to-bottom mixer is shown generally at 10, comprising a body 11, hollow tube 12 adapted to extend down into a drum 13 of liquid and to discharge at its lower end thereby vigorously agitating materials at the bottom of the sealed container.

The two openings 34 are on the opposite sides of the tube. This causes a downward flow from the highest part of the container downward and out the two openings causing a flow across the container regardless of the position of the pump in the container. The body 11 contains a motor that may be an electric motor or other suitable type and may be supported on the top of a drum 13. The motor shaft is connected to the shaft 14 of the mixer, which is supported inside said hollow tube and concentric thereto. A turbine 15 is attached to the lower end of the shaft and the turbine fits snuggly inside the tube. The turbine 15 is made up of two axially spaced plates 16 and 17, and a spool 18 which is disposed concentric to the shaft 14 and fixed to it. The plates 16 and 17 are fixed to the ends of the spool 18 and rotate with the spool 18 and the shaft. The turbine has spaced blades 19, 20, 21 and 22 fixed to the lower side of the top plate and the top side of the lower plate. The blades 19, 20, 21 and 22 are tangential to the spool and terminate at the outer periphery of the plates 16 and 17. The blades 19 through 22 extend generally tangentially of the spool and a square discharge opening 34 is formed in the lower end of the tube. The discharge opening 34 has a height approximately equal to the length of the blades 19 through 22 so that the liquid is discharged centrifically from the blades as the turbine rotates and is projected out through the two openings 34 on opposite sides of the tube. This causes a downflow from the highest part of the container downward out the two openings causing a flow across the container regardless of the position of the pump in the container.

The upper plate 16 has four circumferentially spaced openings 23, 25, 26 and 27 formed in it. These openings are disposed inside the rim 28 and outside the hub portion 33. These openings provide inlet openings for liquid which enters the tube through the inlet openings 24 and 31. Simple teflon bearings hold the shaft in alignment and lip seals cause minimum interference with corrosive vapors.

When the shaft 14 is rotated at high speed by the motor in the body 11, liquid is drawn in through the openings 24 and the opening 31 and down through openings 23, 25, 26 and 27, discharged through openings 34. Thus, the liquid in the tank is recirculated and thoroughly mixed.

The foregoing specification sets forth the invention in its preferred, practical forms, but the structure shown is capable of modification within a range of equivalents without departing from the invention which is to be understood is broadly novel as is commensurate with the appended claims.

The embodiments of the invention in which an exclusive property or privilege is claimed are defined as follows:

1. A top-to-bottom mixer comprising, a body, a hollow tube attached to said body and adapted to extend downward through a relatively small hole in a container of liquid, said body comprising, motor means having a shaft, said shaft is connected to said motor means and extending through said hollow tube concentric thereto, circulation means in said tube fixed to the said concentric shaft causing a downflow through said tube, discharge openings in the wall of said tube adjacent the lower end thereof for discharging liquid from said circulation means causing a high flow of fluid across the bottom of said container when said motor rotates said concentric shaft at a relatively high speed.

2. The mixer recited in claim 1 wherein said circulation means comprises, a turbine having two axially spaced plates, spaced blades fixed to said plates adjacent to the outer periphery of said plates.

said blades extending generally tangentially to said tube, said blades being fixed at their ends to said plates.

3. The mixer recited in claim 2 wherein said circulation means further comprises, a hollow spool disposed concentric to said shaft and fixed thereto.

4. The mixer recited in claim 2 wherein said plates comprise, an upper plate and a lower plate, said upper plate has at least one inlet opening therein for drawing liquid to flow through said tube and out said discharge opening.

5. The mixer recited in claim 4 wherein said opening in the lower end of said tube is rectangular and has a height approximately equal to the length of said blades.

6. The mixer recited in claim 5 wherein said tube has at least one inlet opening adjacent the upper end thereof and a second outlet opening adjacent said rectangular opening.

7. The mixer recited in claim 4 wherein said upper plate has at least four openings therein spaced from each other at positions to receive liquid when said container is partially filled.

8. The mixer recited in claim 7 wherein said upper plate has a rim at a hub and four spokes connected to said hub and extending radially outwardly therefrom and connected to said rim, said rim, hub and spokes define said four openings.

9. The mixer recited in claim 2 wherein said blades are supported on said rim adjacent said spokes.

10. The mixer recited in claim 6 wherein said mixer has four said inlet openings adjacent the upper end thereof.

11. The mixer recited in claim 2 wherein said plates have substantially the same inside diameter of said tube.

12. A mixer comprising, a motor, means for supporting said motor on the cover of a closed container, a tube fixed to said motor, a shaft connected to said motor and extending into said tube concentric thereto, four circumferentially disposed inlet openings in said tube adjacent the upper end thereof and adapted to be disposed below the top surface of liquid in a tank, a discharge opening in said tube adjacent the lower end thereof, and a turbine on said shaft in said discharge opening whereby liquid is drawn through said inlet openings and discharged laterally through said discharge openings in a high pressure blast.

13. The mixer recited in claim 12 wherein said means to cause downward liquid flow is a screw or impeller attached to the said shaft.

14. A method of redissolving crystallized material that has settled on the container bottom or formed on the container walls of a container having a relatively small hole comprising, inserting a tubular member through the wall of said container, the tubular member having a shaft driven by a motor supported on said container connected to said shaft and a turbine member on the shaft, an inlet in the top of the tubular member and diametrically disposed bottom openings forming an outlet at the bottom of said tube, and rapidly circulating said liquid through said tubular member and out said openings to agitate said crystallized material.

* * * * *